US005150594A

United States Patent [19]

Pazzaglia

[11] Patent Number: 5,150,594

[45] Date of Patent: Sep. 29, 1992

[54] MACHINE FOR BEADING CYLINDRICAL CANS OR CAN BODIES

[75] Inventor: Luigi Pazzaglia, Bologna, Italy

[73] Assignee: Cefin S.p.A., Bologna, Italy

[21] Appl. No.: 616,107

[22] Filed: Nov. 20, 1990

[30] Foreign Application Priority Data

Nov. 29, 1989 [IT] Italy ..... 3732 A/89

[51] Int. Cl.[5] ..... B21D 17/04

[52] U.S. Cl. ..... 72/92; 72/94; 413/73; 413/75; 413/76

[58] Field of Search ..... 72/92–94; 413/73, 75, 76

[56] References Cited

U.S. PATENT DOCUMENTS 2,081,042 5/1937 Krueger ..... 72/94
2,407,776 9/1946 Gladfelter ..... 72/94
2,424,581 7/1947 Peters ..... 72/94
2,686,551 8/1954 Laxo ..... 413/73
2,928,454 3/1960 Laxo ..... 72/94

*Primary Examiner*—Bruce M. Kisliuk
*Assistant Examiner*—Jack W. Lavinder
*Attorney, Agent, or Firm*—Banner, Birch, McKie & Beckett

[57] ABSTRACT

A carousel type head revolving about a vertical axis and skirted by a fixed reaction sector is equipped with work stations, each comprising a system of brackets to support the cylindrical tin can and a mandrel consisting in a shaft with an interchangeable outer barrel of diameter notably less than the internal diameter of the can, by which the revolving metal body is pinned against the fixed sector to bring about its deformation; the mandrel and brackets of each station rise and fall synchronously in mutual opposition between respective limit positions, each traversing through a vertical distance substantially equal to half the height of the production can.

14 Claims, 2 Drawing Sheets

MACHINE FOR BEADING CYLINDRICAL CANS OR CAN BODIES

BACKGROUND OF THE INVENTION

The present invention relates to a machine for beading cans or can bodies of cylindrical shape, a particular feature of which is that the cans are conveyed in an upright position and maintained thus throughout the beading operation.

The operation of beading cylindrical tin cans or can bodies consists in deforming the cylindrical wall of the empty can to the end of investing it with increased strength and rigidity.

Conventionally, the operation is effected utilizing machinery that incorporates a revolving head or carousel rotated through at least two stations, one of which feeding in unbeaded cans, and another from which the beaded cans run out.

The revolving head comprises a plurality of work stations, each comprising fixed means by which to support a respective can or can body, and means (a mandrel) by which to constrain and forcibly deform the cylindrical wall. The machine also comprises reaction means positioned between the infeed and runout stations, considered in the direction of rotation of the revolving head, which are embodied as a sector to a cylinder and designed to interact with the constraint means; also, means located at the infeed and runout stations serving respectively to transfer the cans onto and to distance them from the support means of the revolving head.

The support means consist in a surface on which to set the can, and at least one element affording a substantially semicylindrical surface of diameter marginally greater than that of the production can body to be beaded.

Constraint and forcing means at each work station consist in a cylindrical mandrel, coaxial with the semicylindrical surface of the support means and of diameter marginally less than that of the can body to be beaded: thus, each mandrel combines with the relative support means to afford a semicylindrical interstice in which the can wall is accommodated. The mandrel is capable of movement in relation to the support means between a lowered position, which allows the can to be set on the support means, and a raised position of full insertion into the can. In effect, the mandrel is capable of movement in opposite directions through a distance not less than the height of the can to be beaded.

The mutually opposed surfaces of the single mandrel and the reaction means are complementarily shaped, and reflect the selected geometry of the beading to be reproduced by rotation of the mandrel against the reaction surface.

A machine structured after this fashion betrays numerous drawbacks, first among which being that of its inability to adapt to different sizes of cans. Supposing, for example, that the diameter of the can to be beaded is smaller than that for which the machine was last set up, the mandrels and supports must all be replaced with others of suitable size. Thereafter, to ensure proper contact between the wall of the can and the surfaces of the mandrel and the reaction sector on either side, the clearance between mandrel and sector must also be adjusted; this operation is effected either by altering the position of the mandrels or by replacing or moving the reaction sector.

The facility of repositioning the mandrels. hence of altering the circular trajectory described by their axes, obviously must imply a considerably complex structure of the revolving head and a more expensive machine overall.

Replacement of the reaction sector is certainly the more economic option, though in the event that the change sector is of radial depth equal to that of the sector removed, it must be positioned closer to the axis of the revolving head.

At all events, the beading of different size cans, however slight the dissimilarity in diameter to be accommodated, conventionally involves a lengthy replacement of parts and change gears that is both time-consuming, and costly as regards equipment. Functionally, the machine is beset by the drawback that its operating speed may be limited, especially with larger cans; the taller the production can, in fact, the greater the distance the mandrel has to cover on insertion and withdrawal, hence the longer the time required.

A further drawback stems from the inability of the machine to operate with a number of mandrels less than that for which the revolving head is designed. Thus, a user who has no requirement for especially high operating speeds is obliged to purchase a machine having the full set of mandrels, sectors and support means, which must then be operated at a speed lower than the nominal. In short, the outlay on such a machine reflects a heavy investment for the manufacturer operating at relatively low output levels, and a longer amortization period than would normally be the case.

Accordingly, the object of the present invention is to provide a beading machine responding to the type described above, but affording greater flexibility in such a way as to handle different can sizes and enable operation at high and low speeds alike.

SUMMARY OF THE INVENTION

The stated object is achieved in a beading machine according to the present invention, which comprises a rotatable head turning about a vertical axis and carrying a plurality of work stations revolving through two fixed stations at which the cans are fed into and run out from the moving head, also a fixed reaction sector closely encompassing the circular trajectory of the cans occupying the work stations, of which the internal face carries the bead profile to be reproduced and is positioned to enter into contact with the revolving cans.

Each work station incorporates brackets by which the can is supported during its passage from the infeed station to the runout station, and a mandrel comprising a vertical center shaft and a removable outer barrel, of which the external diameter is notably less than the internal diameter of the can; the external surface of the mandrel is fashioned with a profile complementary to that of the fixed sector in such a way that a can pinned forcibly against it by the revolving mandrel will deform and become invested with the beaded profile during passage of the work station from the infeed station to the runout station.

According to the invention, the duration of the machine cycle is advantageously reduced by causing the mandrel and the support brackets of each work station to move synchronously toward and away from one another through a distance corresponding in practice to half the height of the production can.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
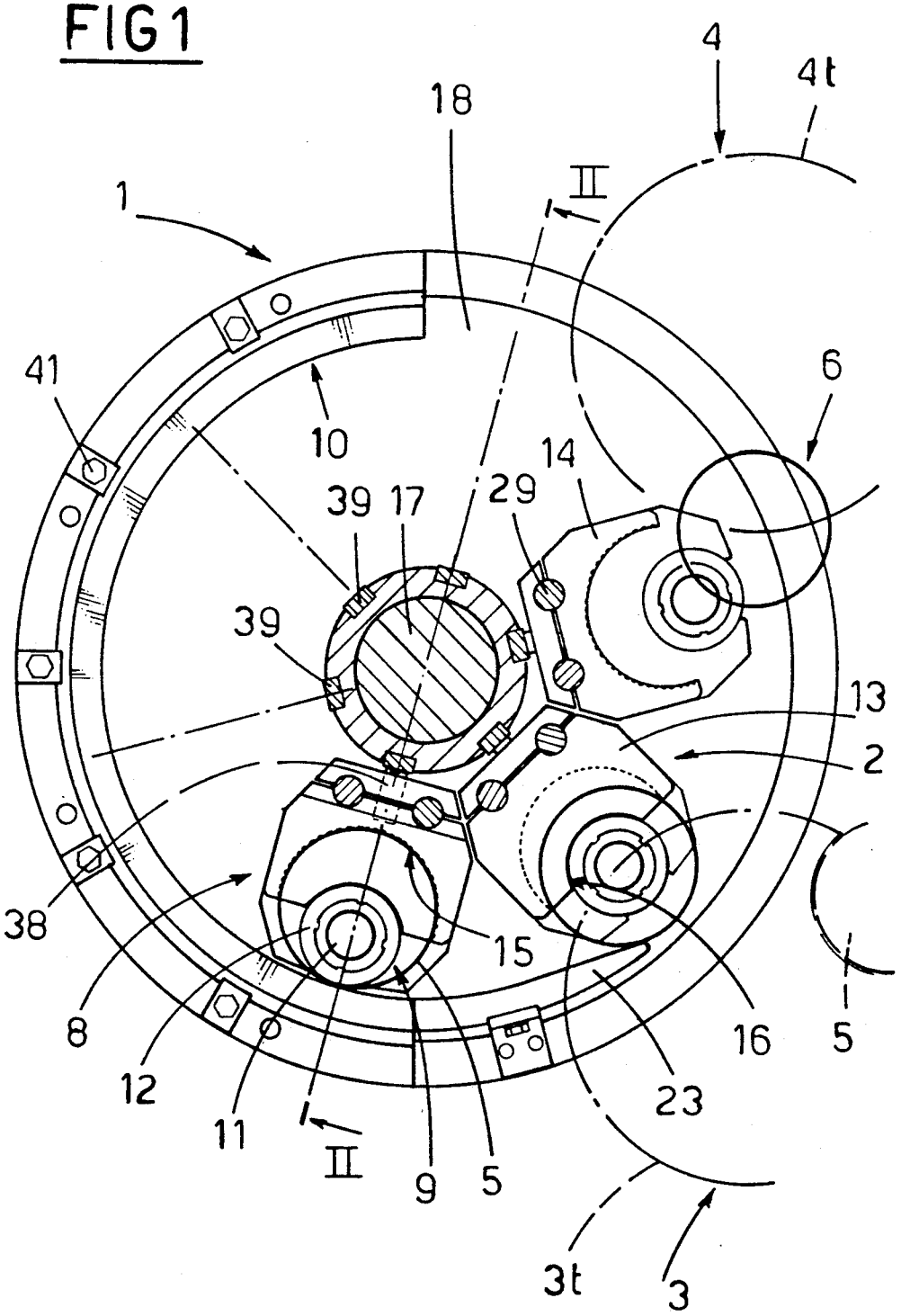
FIG. 1 illustrates the machine in plan with certain parts cut away and certain parts omitted better to reveal others.

With reference to the drawings, the beading machine disclosed, denoted 1 in its entirety, consists essentially in a revolving head or carousel 2 of which the periphery is rotatable through an infeed station 3 and a runout station 4.

The revolving head 2 incorporates a plurality of work stations 7, each affording means 8 by which to support a single can body 5 for beading, and means denoted 9 of which the purpose is to constrain and apply force to the can body 5.

10 denotes fixed reaction means located externally of the revolving head 2, of which the face offered to the head is contoured as a sector to a circle and bears the beading profile 28 to be impressed upon the wall of the can body 5.

Constraint and forcing means consist in a plurality of mandrels 9, and will be referred to as such in the remainder of the specification; essentially cylindrical in embodiment, the single mandrel 9 is invested over its cylindrical surface of revolution with a profile complementary to that of the fixed reaction means 10 (referred to henceforward as the 'fixed sector').

According to the invention, each mandrel 9 consists in a center shaft 11 ensheathed by a coaxial outer barrel 12; thus, it is the barrel which affords the beading profile 28 complementary to that of the fixed sector 10. Moreover the outer barrel 12 is of external diameter decidedly less than the internal diameter of the can body 5 to be beaded, and while rigidly associated with the center shaft 11 by way of a key 27 (see FIG. 2), is removable axially and replaceable with another of different diameter or beading profile 28. The shafts 11 are arranged such that during rotation of the head 2, the barrels 12 will lie at least tangential to the fixed sector 10 as illustrated in the accompanying drawings.

In the embodiment of the machine shown by way of example, the revolving head 2 consists in a fixed shaft 17 disposed with axis vertical and supporting a pair of freely rotatable platforms 18 positioned one above the other, which are set in motion about the vertical axis of the shaft by drive means not illustrated in the drawings.

Figure 2:
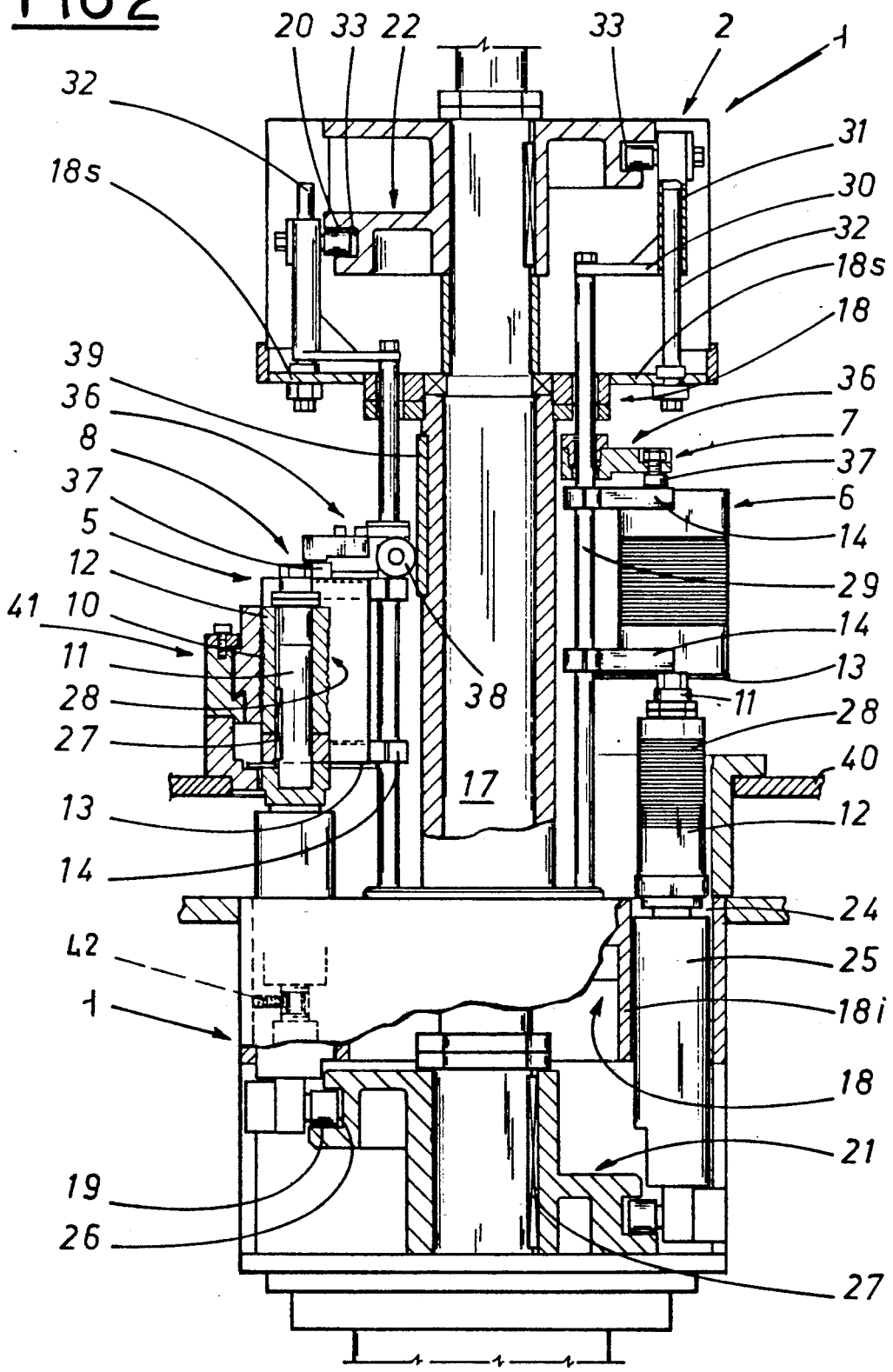
FIG. 2 is a vertical elevation viewed partly in section through II—II of FIG. 1.

The lower platform, denoted **18*i* in FIG. 2, affords a plurality of vertical holes or seatings 24, each slidably accommodating a relative sleeve 25; each such sleeve 25 in its turn accommodates the freely rotatable center shaft 11 of a relative mandrel 9, which extends upward beyond the level of the lower platform 18*i***.

19 denotes a freely revolving roller associated radially with the bottom end of each sleeve 25 and capable of movement internally of a channel 26 afforded by the outermost cylindrical surface of a cam 21 keyed coaxially to the shaft 17 below the level of the lower platform **18*i***.

The lower and the upper platform **18*i* and 18*s* are interconnected mechanically at each work station 7 by a pair of vertically disposed guide rods 29; more exactly, the rods 29 are inserted through and axially slidable in relation to the platforms 18, the top end of each pair being interconnected by a cross member 30 rigidly associated with the bottom end of a sleeve 31 slidably and axially ensheathing a respective vertical post 32 rigidly associated with the upper platform 18*s* (FIG. 2**).

20 denotes a freely revolving roller associated with the topmost end of each sleeve 31 and capable of movement internally of a channel 33 afforded by the outer cylindrical surface of a second cam 22 keyed coaxially to the shaft 17 above the level of the upper platform **18*s***.

The geometry of the cams 21 and 22 and the relative channels 26 and 33 is such that the corresponding rollers, or followers 19 and 20, are drawn together or spread apart synchronously through a distance not less than the height of one can body 5.

The support means 8 at each work station 7 consist in two containing elements 14, one above the other, embodied as brackets permanently associated with and adjustable for position along the corresponding guide rods 29. Viewed in plan (FIG. 1), each such bracket 14 exhibits a C-shaped outline, affording a semicylindrical surface of diameter equal to the largest can body 5 that can be accommodated by the support means 8. It will be observed from FIG. 1 that the axis of the semicylindrical surface of the bracket 14 and that of the mandrel center shaft 11 are offset one from the other.

Also discernible from FIG. 1, the semicylindrical surface of each bracket 14 affords a plurality of magnetic elements 15 capable of attracting the can body 5 held by the respective mandrel 9.

13 denotes a shelf fitted to the underside of each bottom bracket 14 and affording a hole or recess 16 to allow the passage of the respective mandrel 9.

36 denotes an additional bracket located above each of the top brackets 14 and associated rigidly with the guide rods 29, which serves to carry a pair of freely revolving rollers 37 directed downwards with axes vertical and with their peripheral surfaces in vertical and tangential alignment with the center shaft 11 of the relative mandrel 9. In effect, the length of the single center shaft 11 is such that, with the mandrel 9 and support means 8 fully drawn together, contact is established between the center shaft 11 and the two rollers 37, with the rollers lying between the mandrel center shaft 11 and the fixed shaft 17 (FIG. 2).

38 denotes a further roller associated with each of the additional brackets 36, freely rotatable about a moving horizontal axis and in contact with an outer cladding 39 of the fixed shaft 17 (FIG. 2). The fixed sector 10 is permanently associated with and supported by the stationary frame 40 of the beading machine, and exhibits an initial stretch 23 of gradually increasing radial depth departing from the infeed station 3; in operation, this stretch 23 of the sector serves to facilitate the entry of can bodies 5 fed to the machine.

The infeed and runout stations 3 and 4 incorporate respective conveying means denoted schematically by circumferential phantom lines **3*t* and 4*t*, together with respective surfaces by which the unbeaded and beaded can bodies 5 and 6 are supported; these two surfaces occupy the same plane as that occupied by the single shelves 13** when fully raised, as will become clear from the following description of the machine's operation.

The description refers to the steps undergone by one can body 5 only, given that the procedure is repeated identically for each can in turn. The unbeaded can body 5 is transferred from the conveying means of the infeed station 3 to the work station 7 currently positioned alongside. At this juncture, the mandrel 9 and the support means 8 of the work station 7 will be fully spread apart, with the mandrel 9 lying at its lowest possible height and the shelf 13 at its maximum height; remembering also that the diameter of the mandrel 9 is smaller than that of the can body 5, it happens that on arrival of the work station 7 at the fixed sector, the mandrel 9 will be aligned comfortably within the compass of the can body. As the head 2 rotates, the mandrel 9 and the support means 8 draw together through the action of the cams 21 and 22, whereupon the mandrel 9 passes through the shelf 13 by way of the hole or recess 13 and enters the can body 5. The initial stretch 23 of the fixed sector 10 now engages the can body 5, which is thus urged back across the shelf 13, against the brackets 14, and into contact with the barrel 12 of the mandrel 9; once this contact is established, the barrel 12 will begin forcing the can body 5 against the fixed sector 10 and thus bringing about its deformation, which consists investing the cylindrical can wall with the impression of the profiles 28 offered by the matched force and reaction surfaces. The center shaft 11 of the mandrel 12 is neither overhung nor positively engaged during this operating step, as in conventional machines, but supported at the top end by the rollers 37, against which it registers freely and in such a way as will enable continued rotation about its own axis. Approaching the runout area, the two cams 21 and 22 cause the mandrel 9 and the support means 8 to draw apart to the point where, on arrival at the runout station 4, the can body 5 is wholly unencumbered by the mandrel 9 in the transverse direction and can be removed by the respective conveying means 4*t*.

The fixed reaction sector 10 is rigidly associated with the stationary frame 40 of the machine by way of mountings denoted 41, and means 42 will also be provided (FIG. 2) by which to select and adjust the position of the mandrels 9 in relation to the fixed sector 10.

The advantages of a machine thus embodied will be evident: there is no need whatsoever to modify the head in order to accommodate different diameters of can body 5, within a given nominal range of sizes at any rate; in effect, the mandrels 9 describe the selfsame circular trajectory, irrespective of the diameter of the can body 5 to be beaded. The fixed sector 10 and the mandrel barrels 12 need changing only when a different bead profile 28 is adopted. At all events, the position of the mandrel center shafts 11 in relation to the fixed shaft 17 of the head requires no alteration.

By reducing the diameter of the mandrels 9, one has the great advantage that the masses in movement are correspondingly reduced, likewise the nominal power requirement and starting inertia of the machine. With the inclusion of the support rollers 37, and a reduction by half in the degree of movement of the mandrels 9 and the support means 8, as compared to conventional beading machines, increased stability is gained at high operating speeds; the combination of movements also significantly reduces the time taken to position these revolving parts in relation to the can bodies 5.

What is claimed:

1. A machine for beading cylindrical cans or can bodies, comprising:

a revolving head or carousel rotatable about a vertical axis and comprising a plurality of work stations passing singly and in succession through a station at which unbeaded can bodies are fed in and a station at which beaded can bodies run out;

means associated with each of the work stations, by which a can body is supported during passage of the work station from the infeed station to the runout station;

fixed reaction means, extending substantially parallel with and externally of the trajectory followed by a can body carried by the support means of each work station, of which an internal face is positioned to enter into contact with a can body during passage of the work station from the infeed station to the runout station and bears a beaded profile with which the can body is to be invested;

means associated with each of the work stations and positioned so as to constrain a single can body during its passage from the infeed station to the runout station, embodied essentially as a revolving mandrel comprising a vertical center shaft ensheathed by a removable barrel of which the external diameter is significantly less than the internal diameter of the can body and of which an external surface affords a profile complementary to that of the fixed reaction means, in such a way that a can body constrained forcibly between the revolving mandrel and the fixed reaction means will be deformed and invested with an beaded profile during passage of the work station from the infeed station to the runout station;

means by which the mandrel and the support means of each work station are moved toward and away from one another through a distance substantially equal to half the height of the can body.

2. A machine as in claim 1, wherein the fixed reaction means afford an initial guiding stretch departing substantially from the infeed station and designed to urge the unbeaded can body against the mandrel.

3. A machine as in claim 1, wherein the topmost end of each mandrel center shaft is steadied by respective means forming part of the support means, in such a way as to disallow its movement toward the center of the revolving head.

4. A machine as in claim 1, wherein said support means comprises at least one containing element, affording a generally semicylindrical surface directed toward a respective mandrel and a shelf positioned below the containing element, presenting a hole affording passage to the mandrel during movement of the mandrel and the support means toward and away from one another.

5. A machine as in claim 1, further comprising:

at least one revolving platform rotatable about said axis and supporting the constraint means and the support means;

a plurality of cam followers associated one with each of the constraint means and the support means, and operating in conjunction with respective cam means associated rigidly and coaxially with respect to said axis.

6. A machine for beading cylindrical cans or can bodies, comprising:

a revolving head or carousel rotatable about a vertical axis and comprising a plurality of work stations passing singly and in succession through a station at which unbeaded can bodies are fed in and a station at which beaded can bodies run out;

means associated with each of the work stations, by which a can body is supported during passage of the work station from the infeed station to the runout station;

fixed reaction means, extending substantially parallel with and externally of the trajectory followed by a can body carried by the support means of each work station, of which an internal face is positioned to enter into contact with a can body during passage of the work station from the infeed station to the runout station and bears a beaded profile with which the can body is to be invested;

means associated with each of the work stations and positioned so as to constrain a single can body during its passage from the infeed station to the runout station, embodied essentially as a revolving mandrel comprising a vertical center shaft ensheathed by a removable barrel of which the external diameter is significantly less than the internal diameter of the can body and of which an external surface affords a profile complementary to that of the fixed reaction means, in such a way that a can body constrained forcibly between the revolving mandrel and the fixed reaction means will be deformed and invested with a beaded profile during passage of the work station from the infeed station to the runout station;

means by which the mandrel and the support means of each work station are moved toward and away from one another through a distance substantially equal to half the height of the can body;

wherein support means comprise at least one containing element, affording a semicylindrical surface directed toward the relative mandrel and provided with a plurality of elements capable of attracting the can body, and a shelf positioned below the containing element, presenting a hole or recess affording passage to the mandrel during movement of the mandrel and the support means toward and away from one another, and are capable of movement between a raised position, in which the shelf is aligned with further support means afforded respectively by the infeed station and by the runout station, and a lowered position in which the shelf is disposed at a height not lower than that of the relative mandrel.

7. A machine for beading cylindrical cans or can bodies, comprising:

a revolving head or carousel rotatable about a vertical axis and comprising a plurality of work stations passing singly and in succession through a station at which unbeaded can bodies are fed in and a station at which beaded can bodies run out;

means associated with each of the work stations, by which a can body is supported during passage of the work station from the infeed station to the runout station;

fixed reaction means, extending substantially parallel with and externally of the trajectory followed by a can body carried by the support means of each work station, of which an internal face is positioned to enter into contact with a can body during passage of the work station from the infeed station to the runout station and bears a beaded profile with which the can body is to be invested;

means associated with each of the work stations and positioned so as to constrain a single can body during its passage from the infeed station to the runout station, embodied essentially as a revolving mandrel comprising a vertical center shaft ensheathed by a removable barrel of which the external diameter is significantly less than the internal diameter of the can body and of which an external surface affords a profile complementary to that of the fixed reaction means, in such a way that a can body constrained forcibly between the revolving mandrel and the fixed reaction means will be deformed and invested with a beaded profile during passage of the work station from the infeed station to the runout station;

means by which the mandrel and the support means of each work station are moved toward and away from one another through a distance substantially equal to half the height of the can body;

wherein the revolving head comprises:

a fixed and centrally positioned vertical shaft;

two freely revolving platforms located one above the other, supported by and rotatable about the fixed shaft, which serve to support the constraint means and the support means while enabling their movement parallel to the axis of the fixed shaft;

a plurality of cam followers associated one with each of the constraint means and the support means, and operating in conjunction with respective cam means associated rigidly and coaxially with the fixed center shaft.

8. A machine as in claim 7, further comprising means by which the fixed reaction means are associated rigidly with a stationary frame of the machine, and means by which to select and adjust the position of the mandrels in relation to the fixed reaction means.

9. A machine for beading cylindrical cans or can bodies, comprising:

a revolving head or carousel rotatable about an axis and comprising a plurality of work stations passing singly and in succession through a station at which unbeaded can bodies are fed in and a station at which beaded can bodies run out;

means associated with each of the work stations, by which a can body is supported during passage of the work station from the infeed station to the runout station;

fixed reaction means, extending substantially parallel with and externally of the trajectory followed by a can body carried by the support means of each work station, of which an internal face is positioned to enter into contact with a can body during passage of the work station from the infeed station to the runout station and bears a beaded profile with which the can body is to be invested;

means associated with each of the work stations and positioned so as to constrain a single can body during its passage from the infeed station to the runout station, comprising a revolving mandrel having a supported end and a free end, said mandrel having an external diameter which is significantly less than the internal diameter of the can body and of which an external surface affords a profile complementary to that of the fixed reaction means, in such a way that a can body constrained forcibly between the revolving mandrel and the fixed reaction means will be deformed and invested with a beaded profile during passage of the work station from the infeed station to the runout station;

moving means for moving the mandrel of each work station substantially parallel to said axis and for moving the support means of each work station substantially parallel to said axis; said moving means moving said mandrel and moving said support means toward and away from one another through at least a distance substantially equal to half the height of the can body during passage of a respective work station from the infeed station to the runout station.

10. A machine as in claim 9, wherein each mandrel is steadied by respective steadying means forming part of the support means, said steadying means contacting said mandrel on a surface opposite to the fixed reaction means and proximate said free end of the mandrel as to disallow its movement toward the center of the revolving head.

11. A machine as in claim 10, wherein said mandrel comprises a center shaft ensheathed by a removable barrel and said steadying means comprises a roller which contacts said mandrel center shaft.

12. The machine as in claim 9, wherein said distance is substantially equal to half the height of the can body and wherein said axis is substantially vertical.

13. The machine as in claim 12, wherein said support means comprises a first bracket element having a surface which contacts said can body and which is separated a distance parallel to said axis from a second bracket element having a second surface which contacts said can body; and including means for adjusting the position generally parallel to said axis of said first bracket element with respect to said second bracket element so as to accommodate various size can bodies.

14. The machine as in claim 9, wherein each work station contains only a single mandrel member such that a cylindrical can body may only be penetrated from a single side thereof.

* * * * *